United States Patent [19]

Tollar

[11] 4,421,162

[45] Dec. 20, 1983

[54] FLAT PLATE HEAT EXCHANGE APPARATUS

[75] Inventor: James E. Tollar, Midland, Mich.

[73] Assignee: The Dow Chemical Company, Midland, Mich.

[21] Appl. No.: 392,397

[22] Filed: Jun. 25, 1982

[51] Int. Cl.[3] ..... F28D 1/00; F28F 9/22

[52] U.S. Cl. ..... 165/140; 165/145; 165/159; 165/166; 422/138

[58] Field of Search ..... 165/140, 141, 145, 166, 165/167, 159; 422/138; 526/73

[56] References Cited

U.S. PATENT DOCUMENTS

| | | | |
|---|---|---|---|
| 1,961,533 | 6/1934 | Stancliffe | 165/159 |
| 3,014,702 | 12/1961 | Oldershaw et al. | 165/159 |
| 3,280,899 | 10/1966 | Brasie | 165/109 R |
| 3,424,240 | 1/1969 | Stein et al. | 165/166 |
| 3,884,297 | 5/1975 | Fegraus et al. | 165/145 |

*Primary Examiner*—Sheldon J. Richter
*Attorney, Agent, or Firm*—R. B. Ingraham

[57] ABSTRACT

A heat exchange assembly is provided which employs concentric flat plate heaters. The heat exchanger is useful as a reactor particularly where the temperature profile of the material flowing therethrough is controlled or varied.

10 Claims, 4 Drawing Figures

FLAT PLATE HEAT EXCHANGE APPARATUS

This invention relates to a flat plate heat exchange apparatus particularly suited for the handling of viscous liquids.

Oftentimes in the processing of viscous liquids, heat exchange becomes difficult and therefore temperature control becomes difficult. In the processing of certain viscous liquids, for example, a polymer syrup, lack of adequate temperature control can lead to undesirable products. For example, in free radical polymerizations, loss or lack of adequate temperature control can result in products of undesirable molecular weight and hence undesirable physical properties. In isothermal reactions, lack of adequate temperature control may lead to undesired crosslinking and where a thermoplastic product is desired, undesirable crosslinked gels may appear. In some cases, excessive temperature may cause depolymerization coupled with degradation of the molecular weight.

A wide variety of reactors have been developed for handling of viscous liquids. For example, Crawford in U.S. Pat. No. 3,513,145, issued May 19, 1970, discloses an auger type reactor suitable for the continuous mass polymerization process. Another auger type reactor is disclosed by Kii et al. in U.S. Pat. No. 3,679,651 filed Aug. 29, 1962. The heat exchanger of the flat plate variety which was developed for the processing of viscous liquids was disclosed by Oldershaw et al. in U.S. Pat. No. 3,014,702 filed Dec. 1, 1958. A non-short circuiting flat plate heat exchanger reactor suitable for the handling of viscous liquids is disclosed by Brasie in U.S. Pat. No. 3,280,899, filed Mar. 22, 1965.

It would be desirable if there were available an improved heat exchange vessel suitable for reactions involving viscous liquids.

It would also be desirable if there were an improved reactor suitable for the processing of viscous polymer syrups.

It would also be desirable if there were available an improved heat exchange apparatus which permitted control of temperature in at least two zones thereof.

These benefits and other advantages in accordance with the present invention are achieved in a heat exchange vessel, the vessel having an axis extending from a first end to a second end, a foraminous feed tube disposed generally coaxially with the axis of the vessel at least adjacent the first end, a first annular flat plate heat exchanger disposed coaxially about the foraminous tube; at least a second flat plate heat exchanger disposed externally to the first flat plate heat exchanger and generally coaxial therewith; means to supply a first heat exchange fluid to the first flat plate heat exchanger; means to supply a second heat exchange fluid to the second flat plate heat exchanger, the first and second flat plate heat exchangers being disposed within the vessel, the vessel having a product discharge port at the second end of the vessel with the further limitation that each of the flat plate heat exchangers comprise a plurality of generally annular flat plates, each having a centrally disposed aperture, the plate like members assembled perpendicularly to the axis of the vessel with a space between each of the individual plate members; the plate members being positioned in close proximity to one another to provide a flow pattern between adjacent members, the plate members being in spaced apart relationship; a plurality of heat exchange conduits passing through said plate like members to thereby permit circulation of heat exchange fluid through said conduits.

Further features and advantages of the present invention will become more apparent from the following specification taken in connection with the drawing wherein.

Figure 4:
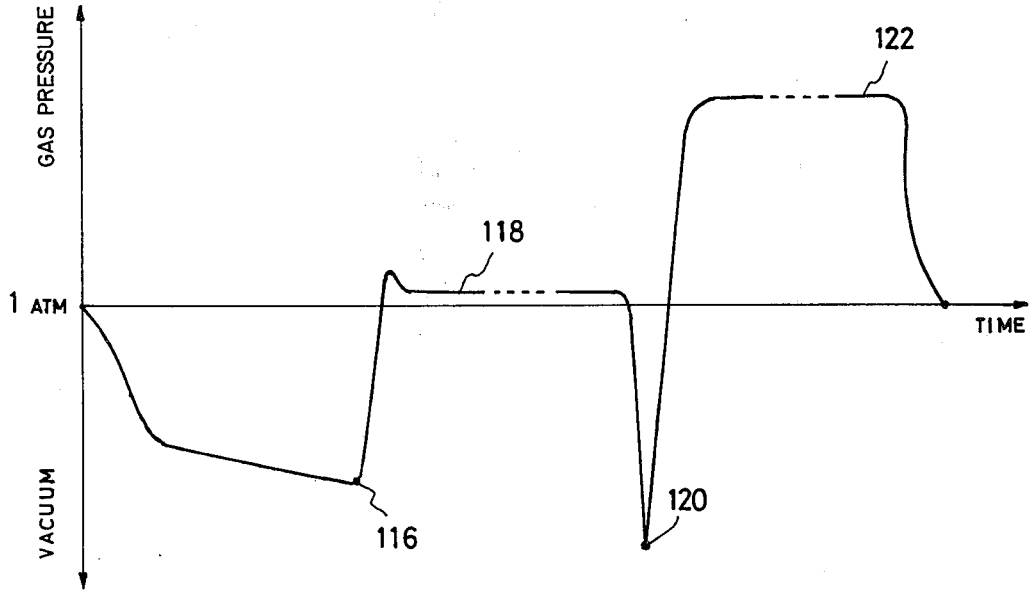
Figure 1:
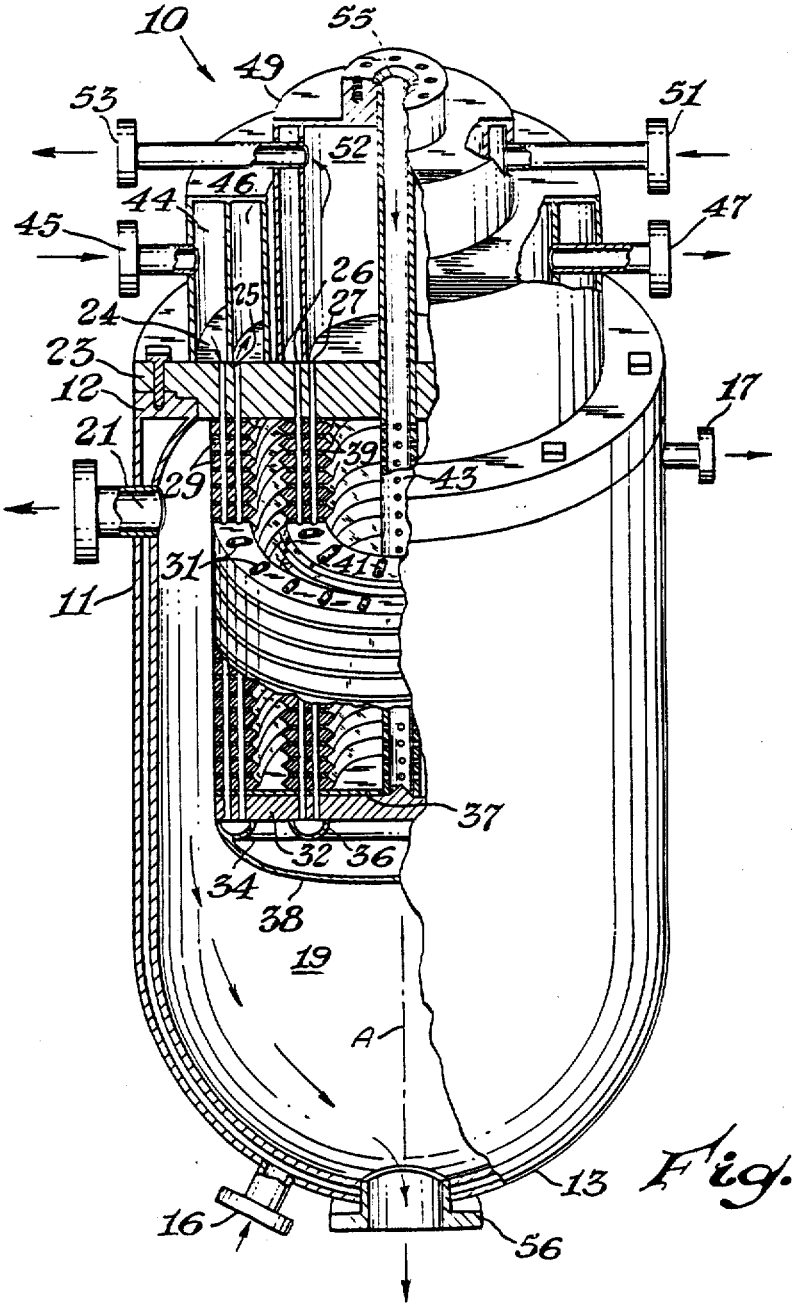
Figure 2:
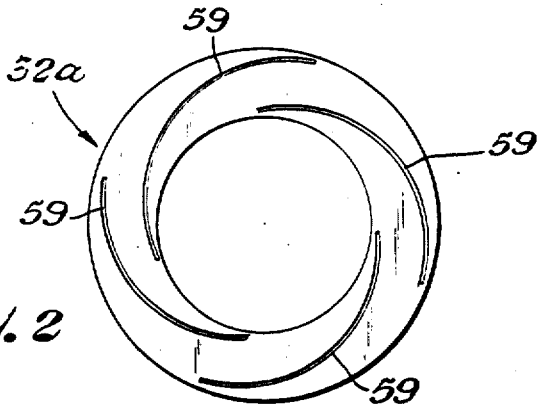
Figure 3:
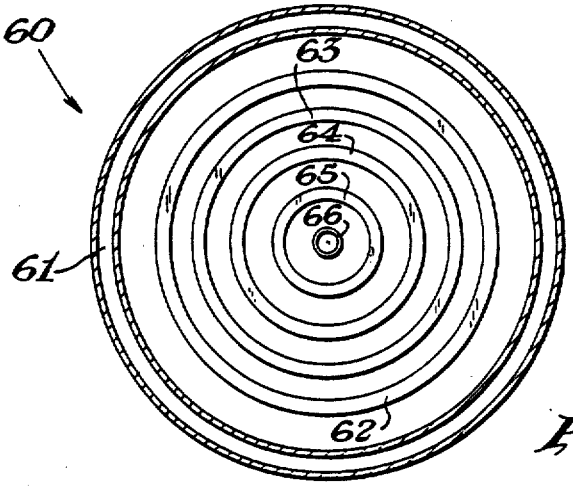
Figure 4:
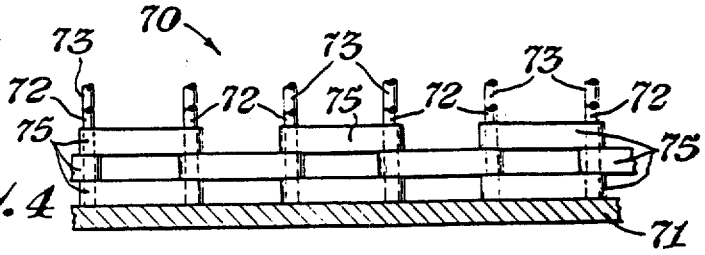

In FIG. 4, there is depicted an alternate construction for flat plates in accordance with the invention.

Figure 1:
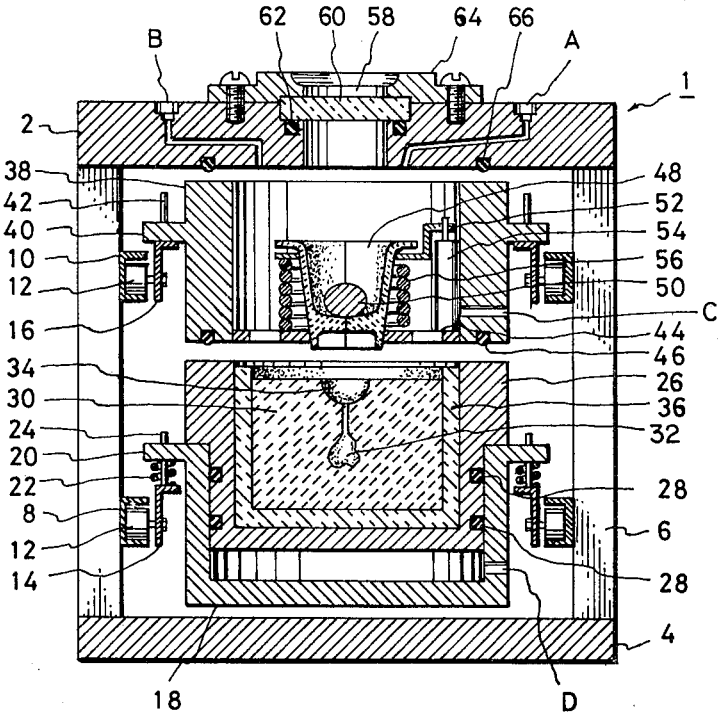
FIG. 1 is a partly in-section view of a heat exchange apparatus in accordance with the present invention.

In FIG. 1 there is schematically depicted a partly in-section view of a heat exchanger in accordance with the present invention generally designated by the reference numeral 10. The heat exchanger 10 comprises a double walled shell or jacketed vessel 11. The shell 11 has an upper or first end 12 and a lower or second end 13. Adjacent the lower end 13 is a jacketed heat transfer medium inlet 16. A jacket heat transfer medium outlet 17 is disposed adjacent the upper or first end 12 of the double walled shell 11. Within the double walled shell 11 is defined a heat exchanger space 19. A volatile discharge port 21 provides communication between the space 19 and space external to the double walled shell 11. A first or upper tube sheet 23 is disposed in sealing relationship with the upper end 12 of the double walled shell 11. The tube sheet 23 has passing therethrough a first plurality of heat exchange fluid tubes 24, and a second plurality of heat exchange fluid tubes 25 is inwardly radially disposed from the tubes 24 toward the axis "A" of the double walled shell 11. A third plurality of heat exchange fluid tubes 26 are generally inwardly radially disposed from tubes 25 toward the axis A. A fourth plurality of heat exchange fluid tubes 27 is radially inwardly disposed from the plurality of tubes 26. The plurality of tubes 24 and 25 passes through a plurality of axially stacked annular plate members 29, each of the members 29 has an inner edge chamfered to about a 90° angle, each of the plates 29 being separated from adjacent plates 29 by means of a plurality of spacers 31. The plurality of tubes 24 and 25 terminate in a bottom tube sheet 32 and into an annular plenum 34. The plurality of tubes 26 and 27 similarly terminate at the bottom tube sheet 32 in a generally annular plenum 36. The plenums 34 and 36 are enclosed by a dished head 38. A generally circular sheet or plate 37 is disposed on tube sheet 32 adjacent and in sealing relationship with the tube sheet 32. The third and fourth series of tubes 26 and 27 have disposed thereon and axially stacked generally similar annular plates 39 which are generally coaxially disposed and enclosed by the annular plates 29. Each of the plates 39 having inner and outer edges are chamfered to about 90°. The plates 39 are separated from adjacent plates 29 by spacers 41. Generally coaxially disposed with the axis A of the double walled shell 11 is a foraminous feed tube 43. The feed tube 43 is affixed to the lower tube sheet 32. Affixed to the tube sheet 23 is a first annular plenum 44 having a heat exchange inlet conduit 45. The plenum 44 communicates with the first plurality of tubes 24. A second annular plenum 46 surrounded by plenum 44 is in communication with the second plurality of tubes 25 and with a heat transfer medium outlet 47. A third annular plenum 49 surrounded by plenum 46 is in communication with a third plurality of tubes 26. The plenum 49 has in communication therewith a heat transfer medium inlet 51. Disposed within and surrounded by the plenum 49 is a fourth plenum 52, which is in communication with the plurality of tubes 27 and a heat transfer medium outlet conduit 53. The foraminous tube 43 terminates at the tube sheet 32 generally adjacent the second end 13 of the shell 11 and at a material inlet 55 generally adjacent the first or upper end 12 of the vessel 11.

In operation of the apparatus of FIG. 1, material to be treated is fed into the inlet 55, passes through the foraminous tube 43 and passes to a space between the plates 39 and the tube 43. The material passes between the plates 39 into a space between the plates 29, and subsequently through the spaces between the plates 29 downwardly toward the second end 13 of the vessel 11 and out through a discharge port 56. Heat exchange fluids at the appropriate temperatures are supplied to the jacket 16 to the inlet 45 and 51 to maintain the jacket and, what may be termed the inner and outer flat plate heaters, at a desired temperature for the process employed. Volatile material if desired may be removed through port 21. It should be noted that the plate 37 is thin relative to the thickness of tube sheet 32. The function of plate 37 may be more clearly understood with reference to FIG. 2.

Figure 2:
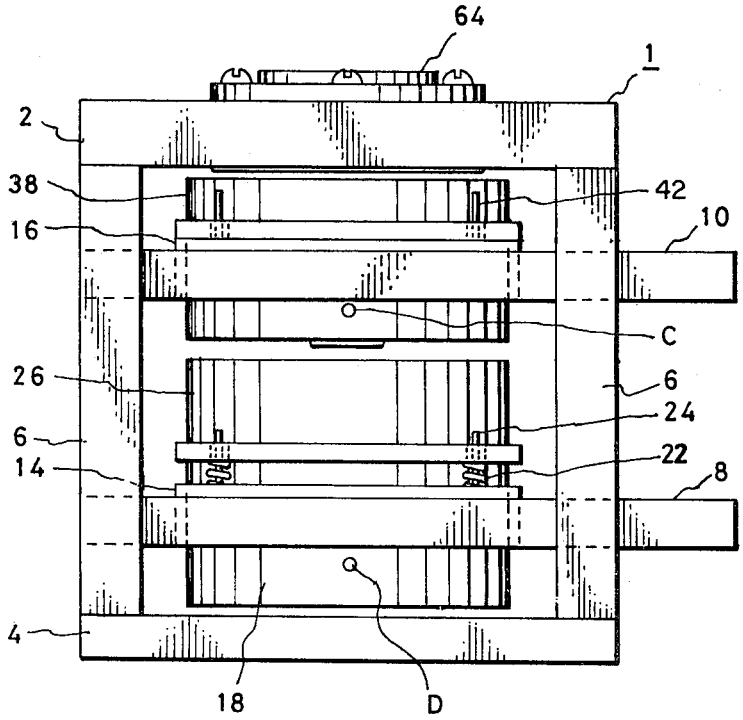
FIG. 2 is a schematic representation of a tube sheet in accordance with the present invention.

In FIG. 2, there is schematically depicted a portion of a tube sheet **32*a* which is disposed between the flat plates such as 29 and 39 of FIG. 1. A plurality of narrow slots 59 have been cut entirely through the tube sheet 32*a* in a generally spiral or arcuate pattern. Such a pattern is highly desirable if there is a substantial temperature differential between the heat exchange fluid supplied to the inlet port such as port 45 and the port 51. The temperature differential can cause substantial thermal stress and deformation which is highly undesirable. By the provision of slots such as the slots 59, high stresses can be avoided and the plate or sheet such as the plate 37 of FIG. 1 provides a means to prevent the material being processed from passing through the slots 59**.

Figure 3:
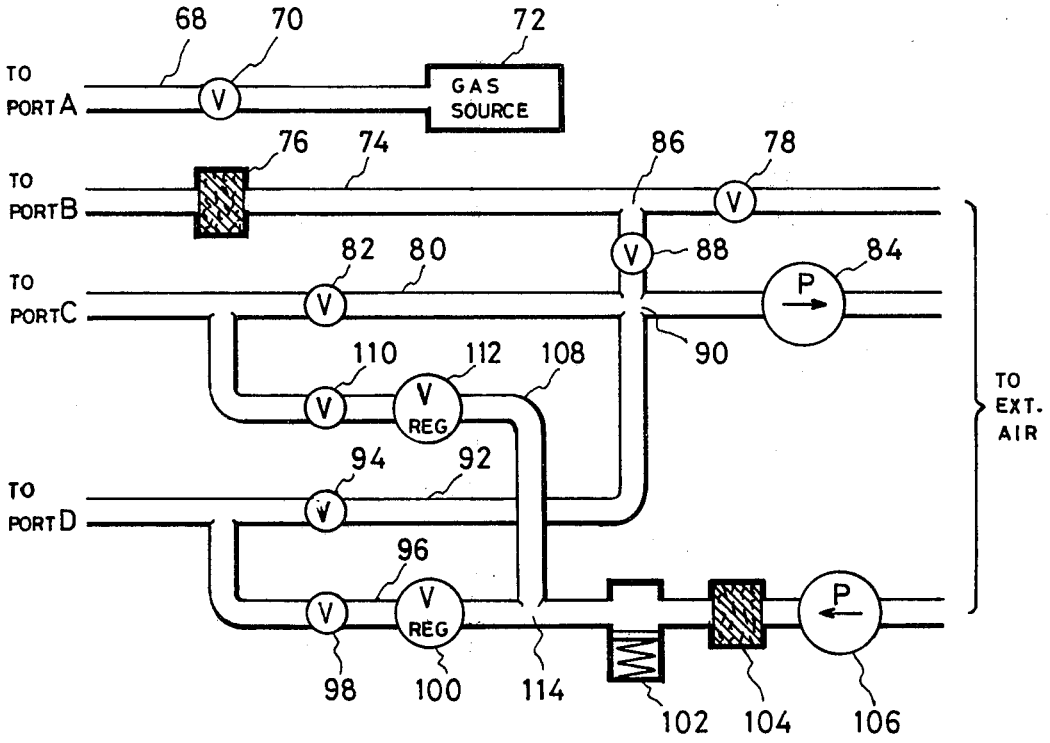
FIG. 3 depicts a schematic sectional view of an alternate embodiment of the invention.

In FIG. 3, there is schematically depicted an alternate arrangement of a heat transfer vessel in accordance with the present invention generally designated by the reference numeral 60. The vessel 60 comprises an external double walled vessel 61 and external flat plate heater assembly 62; a first intermediate flat plate heat exchanger 63 disposed within the heat exchanger 62, and a second intermediate flat plate heat exchanger 64 disposed within the heat exchanger 63, and an inner flat plate heat exchanger 65 disposed within the heat exchanger 64, and a foraminous feed tube 66 generally centrally disposed; the vessel 61, the heat exchangers 62, 63, 64 and 65 and a foraminous tube 66 being generally coaxially disposed.

In FIG. 4, there is schematically depicted a sectional fraction view of an alternate embodiment generally designated by the reference numeral 70 employing a flat plate heat exchanger in accordance with the present invention. The embodiment 70 comprises a tube sheet 71. Passing therethrough is a first plurality of heat exchange fluid tubes generally designated by the reference numeral 72. A second plurality of heat exchange fluid tubes designated by the reference numeral 73 are shown behind the tubes 72. A plurality of blocks or segments designated by the reference numeral 75 of generally identical configuration are disposed over tubes 72 and 73. For example, the configuration of FIG. 70 can be considered as a fractional view from the side of cylindrical flat plate heater generally of the nature of that depicted in FIG. 1 where each of the blocks or segments 75 may be of rectangular configuration and be suitably drilled to receive two members of the group on conduits of 72 and two members of the conduits of 73. By disposing the blocks 75 in spaced apart relationship in the first layer and staggered spaced apart relationship in the second layer, a single flat plate is formed which can extend entirely around the heat exchanger. A third layer above the first and second layer is also disposed in staggered relationship to the second layer to provide one-half of the second layer of a circular flat plate. The blocks such as the blocks 75 may be of rectangular configuration or have the configuration of an isosceles trapezoid or any variation thereof depending upon the needs of a particular application.

Beneficially, flat plate heat exchangers in accordance with the present invention can be constructed with obvious boiler-making procedures of machining and welding. However, with regard to the heat exchange fluid conduits, such as conduits 24, 25, 26 and 27 of FIG. 1 and conduits 72 and 73 of FIG. 4, it is frequently desirable to assemble all of the heat exchange elements and/or spaces and hydraulically expand the tubes. Very satisfactory metal-to-metal contact is obtained.

Employing heat exchange vessels in accordance with the present invention permits the use of a wide variety of different profiles and the material being processed in such vessels provides a highly desirable degree of control of the reaction mixture.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A heat exchange vessel, the vessel having an axis extending from a first end to a second end, a foraminous feed tube disposed generally coaxially with the axis of the vessel at least adjacent the first end, a first annular flat plate heat exchanger disposed coaxially about the foraminous tube; at least a second flat plate heat exchanger disposed externally to the first flat plate heat exchanger and generally coaxial therewith; means to supply a first heat exchange fluid to the first flat plate heat exchanger; means to supply a second heat exchange fluid to the second flat plate heat exchanger, the first and second flat plate heat exchangers being disposed within the vessel, the vessel having a product discharge port at the second end of the vessel with the further limitation that each of the flat plate heat exchangers comprise a plurality of generally annular flat plates, each having a centrally disposed aperture, the plate like members assembled perpendicularly to the axis of the vessel with a space between each of the individual plate members; the plate members being positioned in close proximity to one another to provide a flow pattern between adjacent members, the plate members being in spaced apart relationship; a plurality of heat exchange conduits passing through said plate like members to thereby permit circulation of heat exchange fluid through said conduits.

2. The heat exchange vessel of claim 1 having more than two flat plate heat exchangers.

3. The vessel of claim 2 wherein the heat exchange conduits of the first and second flat plate heat exchangers terminate in annular plenums adjacent the second tube sheet.

4. The heat exchange vessel of claim 1 having at least 1 tube sheet, said tube sheet having a plurality of generally arcuate slits formed therein.

5. The heat exchanger of claim 1 wherein the flat plates are formed from a plurality of block-like elements with ends of adjacent blocks overlapping and adjacent spaced apart blocks which are coplanar in combination with a second plurality of blocks which are coplanar.

6. The vessel of claim 1 wherein the vessel is jacketed and the jacketed vessel has heat exchange inlets and outlets.

7. The heat exchanger of claim 1 wherein in each flat plate heat exchanger, the tubes are arranged in pairs and one member of each pair communicates with a generally annular input plenum and one member of each pair communicates with an output plenum adjacent the first end of the vessel.

8. The vessel of claim 1 wherein the flat plates are planar.

9. The vessel of claim 1 wherein adjacent plates are separated by a plurality of spacer elements disposed therebetween and having at least a pair of heat exchange conduits passing therethrough.

10. The vessel of claim 1 wherein the second tube sheet in a region betweeen the flat plate heat exchangers defines a plurality of slots, the slots being in a generally spiral pattern, said second tube sheet having disposed thereon a liquid impermeable sheet of lesser thickness, the second tube sheet, the impermeable sheet, being disposed generally adjacent the first tube sheet.

* * * * *

UNITED STATES PATENT AND TRADEMARK OFFICE

CERTIFICATE OF CORRECTION

PATENT NO. : 4,421,162

DATED : December 20, 1983

INVENTOR(S) : James E. Tollar

It is certified that error appears in the above-identified patent and that said Letters Patent is hereby corrected as shown below:

The title page should be deleted to appear as per attached title page. Sheets 1 and 2 of the drawings should be deleted to appear as per attached sheets.

Signed and Sealed this

*First* Day of *May 1984*

[SEAL]

*Attest:*

GERALD J. MOSSINGHOFF

*Attesting Officer*

*Commissioner of Patents and Trademarks*

United States Patent [19]

Tollar

[11] 4,421,162

[45] Dec. 20, 1983

[54] FLAT PLATE HEAT EXCHANGE APPARATUS

[75] Inventor: James E. Tollar, Midland, Mich.

[73] Assignee: The Dow Chemical Company, Midland, Mich.

[21] Appl. No.: 392,397

[22] Filed: Jun. 25, 1982

[51] Int. Cl.[3] ..... F28D 1/00; F28F 9/22

[52] U.S. Cl. ..... 165/140; 165/145; 165/159; 165/166; 422/138

[58] Field of Search ..... 165/140, 141, 145, 166, 165/167, 159; 422/138; 526/73

[56] References Cited

U.S. PATENT DOCUMENTS

| | | | |
|---|---|---|---|
| 1,961,533 | 6/1934 | Stancliffe | 165/159 |
| 3,014,702 | 12/1961 | Oldershaw et al. | 165/159 |
| 3,280,899 | 10/1966 | Brasie | 165/109 R |
| 3,424,240 | 1/1969 | Stein et al. | 165/166 |
| 3,884,297 | 5/1975 | Fegraus et al. | 165/145 |

*Primary Examiner*—Sheldon J. Richter
*Attorney, Agent, or Firm*—R. B. Ingraham

[57] ABSTRACT

A heat exchange assembly is provided which employs concentric flat plate heaters. The heat exchanger is useful as a reactor particularly where the temperature profile of the material flowing therethrough is controlled or varied.

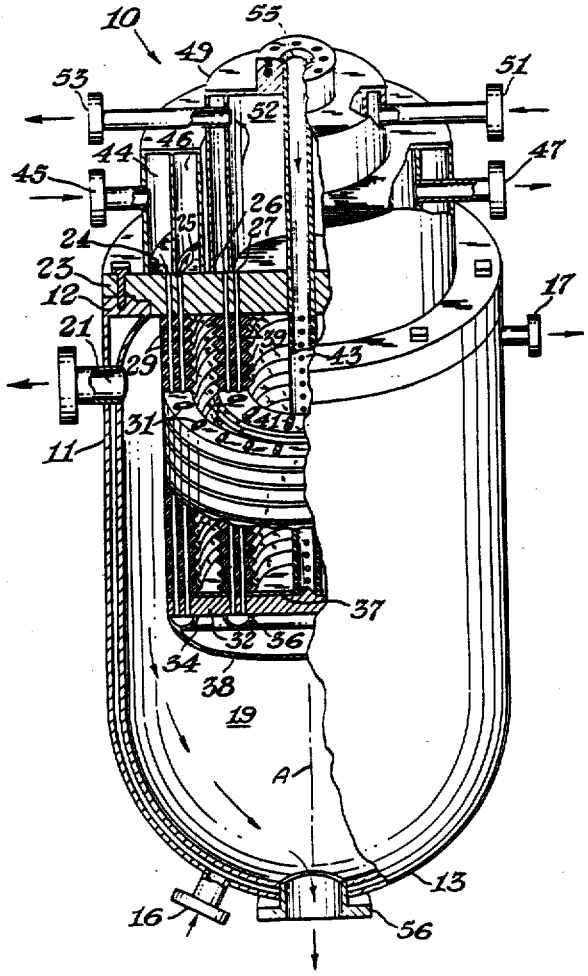

10 Claims, 4 Drawing Figures